United States Patent [19]

Miyata

[11] Patent Number: 4,862,608

[45] Date of Patent: Sep. 5, 1989

[54] PRESSING PLATE MULTI-DIRECTIONAL MOVING APPARATUS FOR A CLOTHES PRESS

[76] Inventor: Yukio Miyata, 738-4, Kodera, Mihara-cho, Minamikawachi-gun, Osaka, Japan

[21] Appl. No.: 195,658

[22] Filed: May 18, 1988

[30] Foreign Application Priority Data

Jul. 29, 1987 [JP] Japan ..... 62-189476

[51] Int. Cl.[4] ..... D06F 71/04

[52] U.S. Cl. ..... 38/31

[58] Field of Search ..... 38/27, 103, 104, 30, 38/135, 28, 31, 42, 43; 248/117.1; 223/57, 52.1, 52.5

[56] References Cited

U.S. PATENT DOCUMENTS

| | | | |
|---|---|---|---|
| 116,057 | 6/1871 | Howe | 38/30 |
| 137,100 | 3/1873 | Sawyer | 38/30 |
| 901,836 | 10/1908 | Rogers et al. | 38/103 |
| 1,868,934 | 7/1932 | Zacharias | 38/30 |
| 1,883,861 | 10/1932 | Baker | 38/27 |
| 1,883,863 | 10/1932 | Baker | 38/30 |
| 2,189,215 | 2/1940 | Malott | 38/31 |
| 2,287,646 | 6/1942 | Steele | 38/104 X |
| 3,234,672 | 2/1966 | Foster | 38/30 |

*Primary Examiner*—Andrew M. Falik

*Attorney, Agent, or Firm*—Moonray Kojima

[57] ABSTRACT

An ironing apparatus used for making gather lines in a skirt, making creases in a garment such as a blouse, a shirt, or a pair of trousers, and smoothing out wrinkles in the trousers comprises an ironing table disposed horizontally on the working surface of a main body thereof, a pressing plate disposed opposite to and above the ironing table, and a lifting device for moving the pressing plate vertically to and from the ironing table. It further includes forward and backward and rightward and leftward moving apparatus so that the pressing plate can perform ironing through pressing in a vertical direction without disturbing the shape of the garment. Advantageously, the apparatus can thus be handled with ease and additionally, can protect an operator from receiving a blast of hot air emanating the pressing plate. The pressing plate is defined by a C-shaped support arm, the top end of which is located above the ironing table.

4 Claims, 7 Drawing Sheets

PRESSING PLATE MULTI-DIRECTIONAL MOVING APPARATUS FOR A CLOTHES PRESS

BACKGROUND OF THE INVENTION

The a prior art apparatus used for ironing clothes, for example, has a large pressing plate mounted pivotably to the rear end of a main body thereof so that a garment on an ironing table can be pressed down with the pressing plate actuated for upward and downward movement on a pivot located in the rear end by hand or with the use of a hydraulic cylinder.

Accordingly, the pressing plate of the prior art apparatus moves downward in a vertically extending curve (i.e. about a rotative axi) to come into contact with the ironing table and thus, will press against the garment on the ironing table in slightly unaligned engagement. This causes creases or folds in the garment placed over the ironing table, e.g. in a gathered skirt or a pair of trousers, to become loose during pressing operation although such creases or folds were originally arranged to be straight. This results in double creases or folds or damage to the shape of the skirt or trousers.

Additionally, when the pressing plate is turned backward of the main body in pivotal movement, its bottom faces the operator. As a result, hot air discharged from the pressing plate will blow directly into the face and hands of the operator standing in front of the Apparatus. The working condition for the operator is thus dangerous.

OBJECTS OF THE INVENTION

It is a primary object of the present invention to provide an ironing apparatus in which a pressing plate is substantially vertically moved to and from an ironing table, as constrasted to the conventional pivoting movement, so that clothes can neatly be ironed without any damage to the shapes thereof incorporating folds and creases for gathering and additionally, so that the operator is not exposed to any blast of hot air from the ironing plate. Advantageously, this allows an unskilled operator to operate the apparatus without difficulty.

It is another object of the present invention to provide an ironing apparatus in which a pressing plate has its upper position spaced from an ironing table and is movable backward or laterally for retracting action. Thus, conventional limited movement of the pressing plate is eliminated. This allows an unskilled operator to iron clothes with ease.

It is a further object of the present invention to provide an ironing apparatus which comprises a plurality of ironing tables mounted on the working surface thereof and a single pressing plate movable substantially vertically of the ironing tables and also adapted for rightward and leftward movement so that the working efficiency is improved by concurrently pressing one pressing plate against one of the ironing tables, and preparing another pressing plate for ironing operation on the next ironing table. Thus, the apparatus requires less space for installation with ease of arrangement. A plurality of ironing operations can thus be carried out at the same time in a single machine.

The foregoing objects are attained in the invention which encompasses an ironing apparatus utilized for making gather lines in a skirt, making creases in a garment such as a blouse, a shirt, a pair of trousers, or the like, and smoothing out wrinkles in such garments, which apparatus comprises an ironing table disposed horizontally on the working surface of a main body; a pressing plate disposed above the ironing table in confronting relationship thereto; lifting means for moving the pressing plate vertically to and from the ironing table; a first moving means for moving the pressing plate forward and backward; and a second moving means for moving the pressing plate rightward and leftward so that the pressing plate performs pressing operation in a substantially vertical downard direction without disturbing the shape of the garment. Thus, advantageously, the ironing apparatus can be handled with ease, and does not expose the operator to hot air or steam emanating from the pressing plate.

BRIEF DESCRIPTION OF THE DRAWINGS

The drawings illustrate embodiments of the present invention, in which.

DESCRIPTION OF THE PREFERRED EMBODIMENTS

Figure 1:
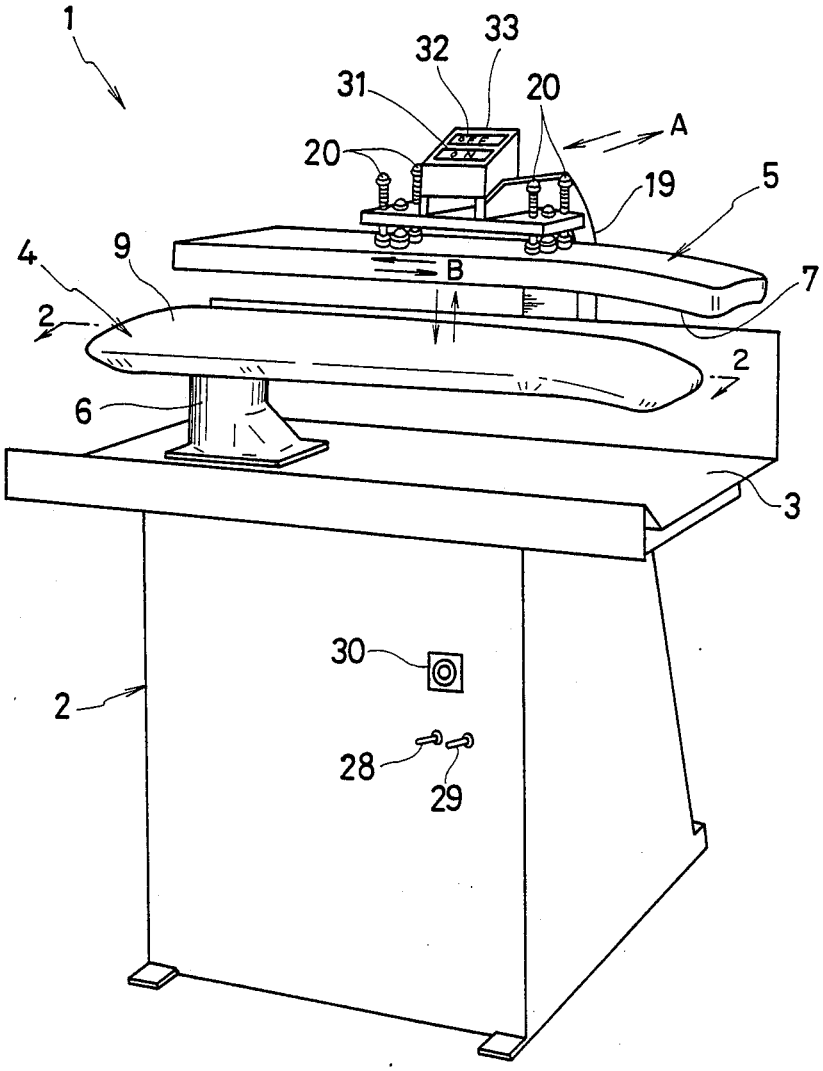
FIG. 1 is an external perspective view of an ironing apparatus.

FIG. 1 shows an ironing apparatus for ironing a skirt. The ironing apparatus 1 comprises an ironing table 4 horizontally mounted on the working surface 3 of a main body 2 thereof and a pressing plate 5 mounted above the ironing table 4 for vertically liftable movement.

Figure 2:
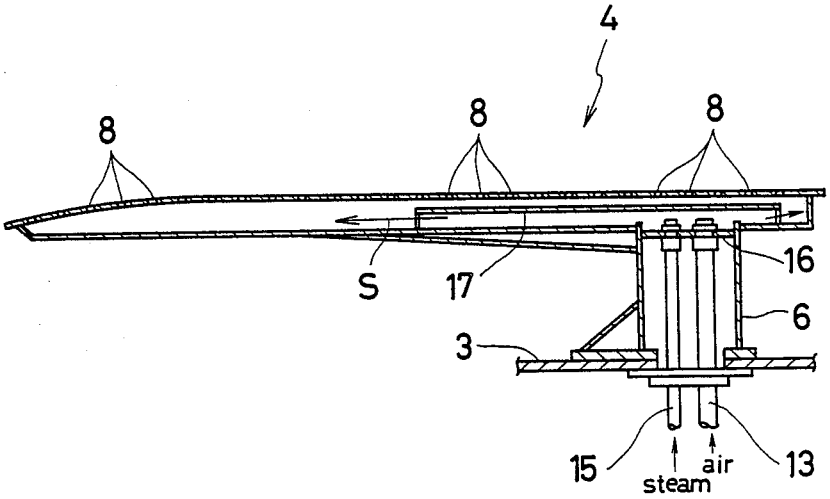
FIG. 2 is a cross sectional view of the ironing table shown in FIG. 1, as taken along section line 2—2.
Figure 3:
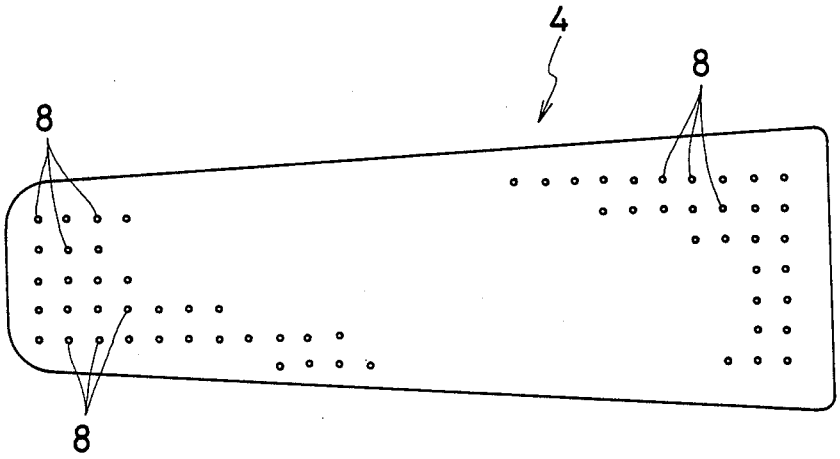
FIG. 3 is a plan view of the ironing table shown in FIG. 1.

The ironing table 4 is formed of a hollow shape from metal such as stainless steel and fixedly mounted to the top of a tubular support 6 uprightly mounted on the working surface 3 so that the hollow space thereof can communicate with that of the tubular support 6, as shown in FIGS. 2 and 3. The ironing table 4 has an upper surface which is formed in smooth, arcuate configuration corresponding to the shape of a pressing surface 7 in the bottom of the pressing plate 5 and additionally, has a multiplicity of tiny holes 8 arranged at equal intervals therein.

The ironing table 4 is protected with an air-permeable cover cloth 9 as shown in FIG. 1.

Figure 4:
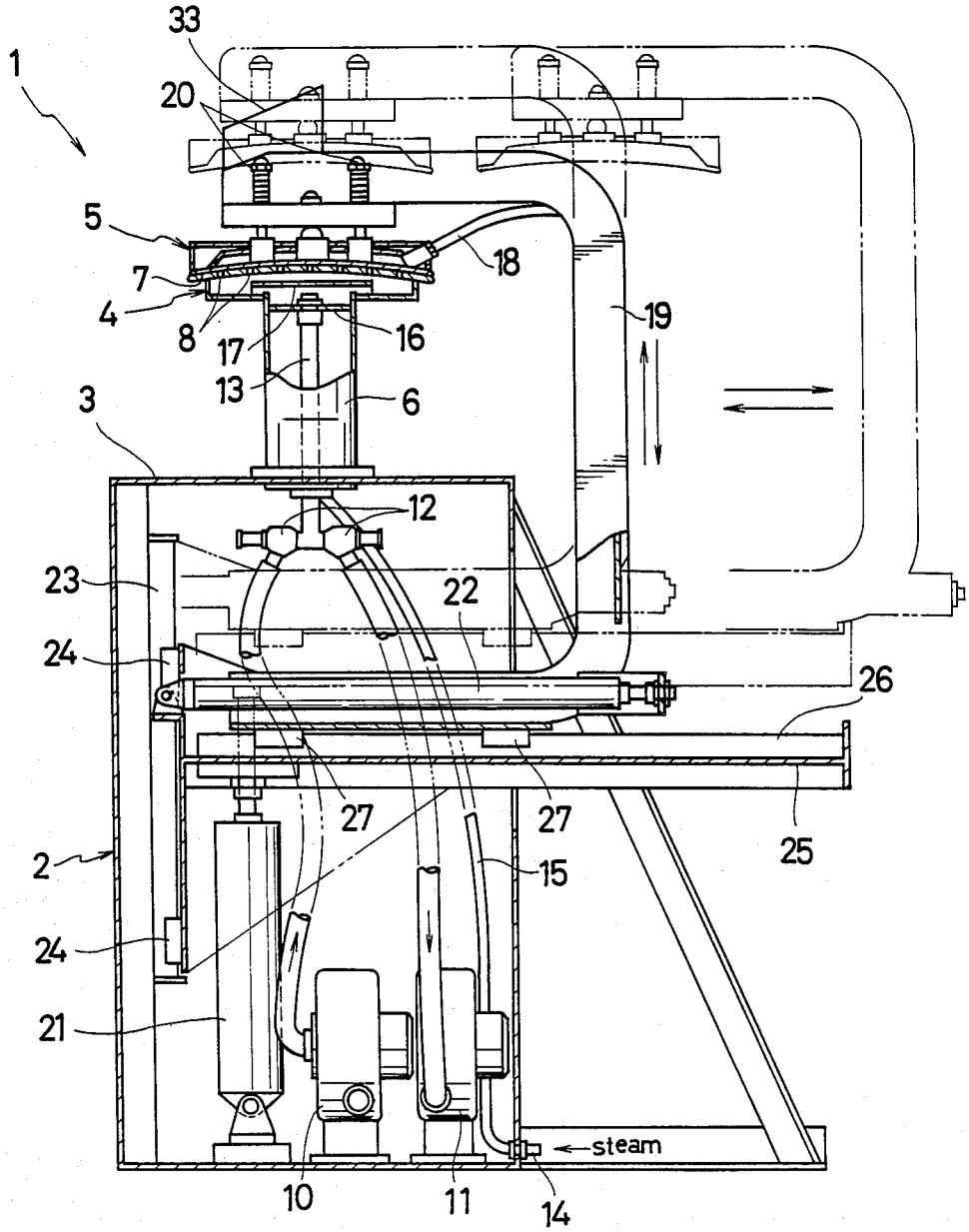
FIG. 4 is a longitudinal cross sectional view of the ironing apparatus.

As shown in FIG. 4, there is provided an air flowing line 13 connected to both an air supply blower 10 and an air suction blower 11 disposed in the main body 2 via their respective electro-magnetic valves 12. A steam supply line 15 is connected to a steam supplying device (not shown) via a steam supply port 14 mounted in a lower portion of the apparatus. Both of the supplies are joined to a closing plate 16 fixedly mounted within the support 6 thus to fluidly communicate with the hollow space of the ironing table 4.

Additionally, there is a dispersion plate 17 adapted for the dispersion of steam S discharged from the steam supply line 15. The dispersion plate 17 is mounted in the front of both discharging outlets of the air flowing line 13 and steam supply line 15 so that the flow of steam S can outwardly pass through the tiny holes 8 uniformly.

The pressing plate 5 is also formed of a hollow shape from metal such as stainless steel, while its pressing surface 7 in the bottom is formed into smoothly curved configuration corresponding to the shape of the ironing table 4, and provided with a steam supply line 18 fluidly connected at one end to the hollow space thereof and at the other end to a steam supplying device (not shown) respectively.

The pressing plate 5 incorporates a C-shaped support arm 19 the top end of which is located above the ironing table 4 in such a manner that it is fixedly attached to the lower surface of the top end of the support arm 19 by a plurality of bolts 20 so that it can face downward.

On the other hand, the lower end of the support arm 19 is mounted in the main body 2 which accommodates a lifting cylinder 21 as a lifting means. The pressing plate 5 can thus be moved vertically to and from the ironing table 4 by the lifting cylinder 21.

Additionally, there is a cylinder 22 for forward and backward movement provided as forward and backward moving means in order to move the pressing plate 5 (which is at an upper position spaced upward from the ironing table 4) in the forward and backward directions of the main body 2.

The arrangement of the cylinders 21, 22 relative to the support arm 19 and the main body 2 is as follows:

The main body 2 accommodates a lifting guide 23 fixedly mounted thereto in vertical arrangement. The lifting guide 23 incorporates a lift member 25 mounted for vertical movement by slide blocks 24. A piston rod of the lifting cylinder 21 is joined to the bottom of the lift member 25.

The lower end of the support arm 19 is mounted for forward and backward movement to a longitudinal movement guide 26 on the lift member 25 by slide blocks 27, 27 so that a piston rod of the longitudinal motion cylinder 22 disposed on the lift member 25 can actuate the support arm 19 to move forward and backward.

The lifting cylinder 21 actuates a unit of the pressing plate 5, support arm 19, and lift member 25 to move vertically for upward and downward motion. Then, while the pressing plate 5 is at its upper position, the longitudinal motion cylinder 22 actuates a unit of the pressing plate 5 and support arm 19 to move forward and backward.

There are a main switch 28, a timer switch 29, and a timer 20 for setting a pressing time for the pressing plate 5 and a stand-by time of the same at the rear of the apparatus, each of which is mounted on the front panel of the main body 2 as shown in FIG. 1. Additionally, the pressing plate 5 has a switch box 33 containing an ON switch 31 and an OFF switch 32 for controlling the cylinders 21 and 22 and mounted thereabove.

The first embodiment illustrated is arranged as set forth above and its function will now be described.

When the main switch 28 and timer switch 29 in the front are turned on, every component gets ready to operate.

After a skirt (not shown) for instance is placed over the ironing table 4, the air flowing line 13 is then connected with the air suction blower 11 through switching motion of the electromagnetic valve 12. The suction of the air suction blower 11 thus allows the skirt to remain held by suction to the surface of the ironing table 4. While the gathered skirt is tightly held to the upper surface of the ironing table 4 by means of the suction of the air suction blower 11, its fold lines can be arranged straight in order for preparation.

After that, the ON switch 31 on the switch box 33 is pressed to move the pressing plate 5 forward upto a pressing position on the ironing table 4. The pressing plate 5 then presses against the skirt on the ironing table 4 for a specified period of time, e.g. about 3 seconds, determined by the timer 30 without disturbing the shape of the skirt upon moving vertically in a downward direction toward the ironing table 4.

Then, the air flowing line 13 is disconnected through switching motion of the electromagnetic valve 12. The steam S supplied from the steam supply line 15 is then discharged uniformly through the tiny holes 8 formed in the ironing table 4 so as to steam the skirt at a pressure for a specified time, e.g. about 3 seconds, for the purpose of smoothing wrinkles.

After this action is completed, the pressing plate 5 moved is upward and retracted backward of the apparatus. Simultaneously, the air flowing line 13 is connected to the air supply blower 10 through the directional valve 12. The flow of air (hot or cool) from the air supply blower 10 is discharged through the tiny holes 8 in the ironing table 4 so that the skirt can securely be shaped into a gathered form.

While the pressing plates 5 is kept at its backward position for a specified time, e.g. about 3 seconds, the skirt on the ironing table 4 is turned over. As an unfinished gathered portion of the skirt is tightly held by suction to the upper surface of the ironing table 4, the fold lines in the skirt are arranged straight repeatedly in the same manner above described before ironing.

In case that the timer 30 is not used for manual ironing operation, the timer switch 29 should be kept turned off.

When the ON switch 31 is pressed in such a condition, the pressing plate 5 advances horizontally forward to its pressing position and then vertically downward to press against the ironing table 4. After ironing, the pressing plate 5 moves vertically upward and then retracts horizontally backward to its original position for stopping when the OFF switch 32 is pressed.

As set forth above, the pressing plate 5 moves vertically for pressing operation after having been moved to over the ironing table 4 and its pressing force is downwardly exerted on the ironing table 4 so that it can firmly press against the skirt on the ironing table 4 without spoiling the fold lines in the gathered skirt. Thereby, wrinkles in the skirt are removed with the use of steam S and the skirt is properly ironed while retaining its shape.

Additionally, the pressing plate 5 moves upward and downward with its pressing surface 7 constantly facing downward so that the hot air from the pressing plate 5 is prevented from blowing against the face and hands of an operator. This allows an unskilled operator to easily operate the apparatus without fearing for his safety as would be the case with a conventional pressing plate and particularly, will also provide an improved working condition.

Although the embodiment described above employs the pressing plate 5 which is movable forward and backward (seee arrows "A" in FIGS. 1 and 5), it will be understood that equal effect is possible with a pressing plate movable rightward and leftward (see arrows "B" in FIGS. 1 and 5) of the ironing table 4.

Second Embodiment

FIGS. 5 to 12 illustrate an embodiment in which two ironing tables 4A and 4B are horizontally mounted on the working surface 3 of a main body 2 of the apparatus, in which similar number represents similar member as shown in FIGS. 1–4.

The two ironing tables 4A and 4B are spaced at a specified interval from each other laterally of the working surface 3 of the main body 2, Table 4A is formed in a shape corresponding to a sleeve portion of a garment. Table 4B is formed in a shape corresponding to a body portion of the garment.

Figure 6:
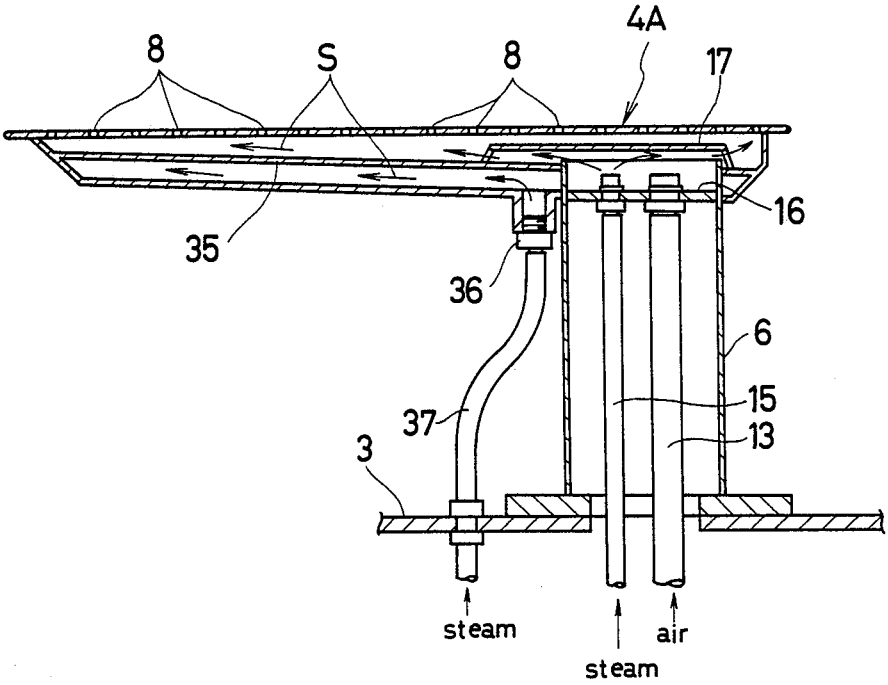
FIG. 6 is a cross sectional view of an ironing table for a sleeve shown in FIG. 5, as taken along section line 6—6.
Figure 7:
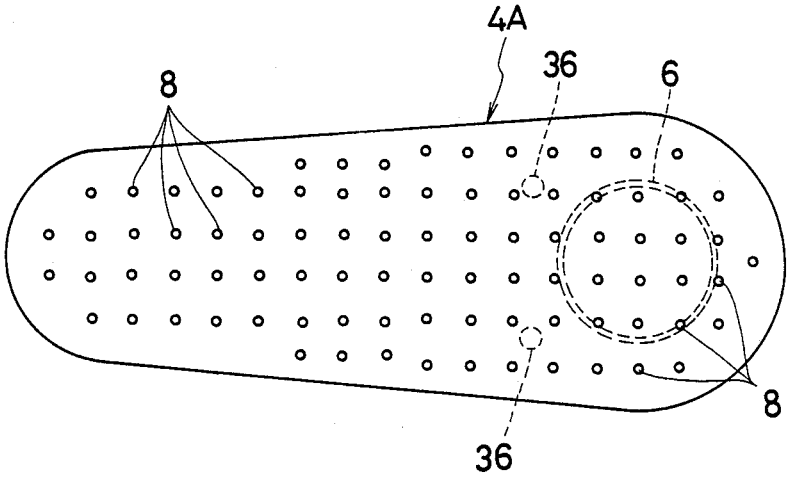
FIG. 7 is a plan view of the ironing table for a sleeve.
Figure 8:
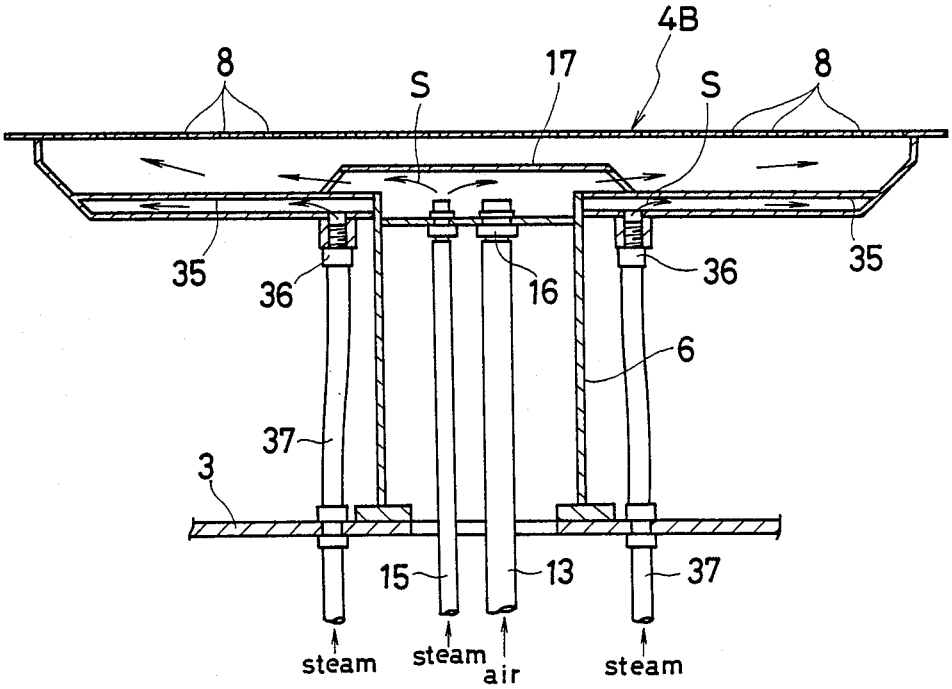
FIG. 8 is a cross sectional view of an ironing table garment body shown in FIG. 5 as taken along section line 8—8.
Figure 9:
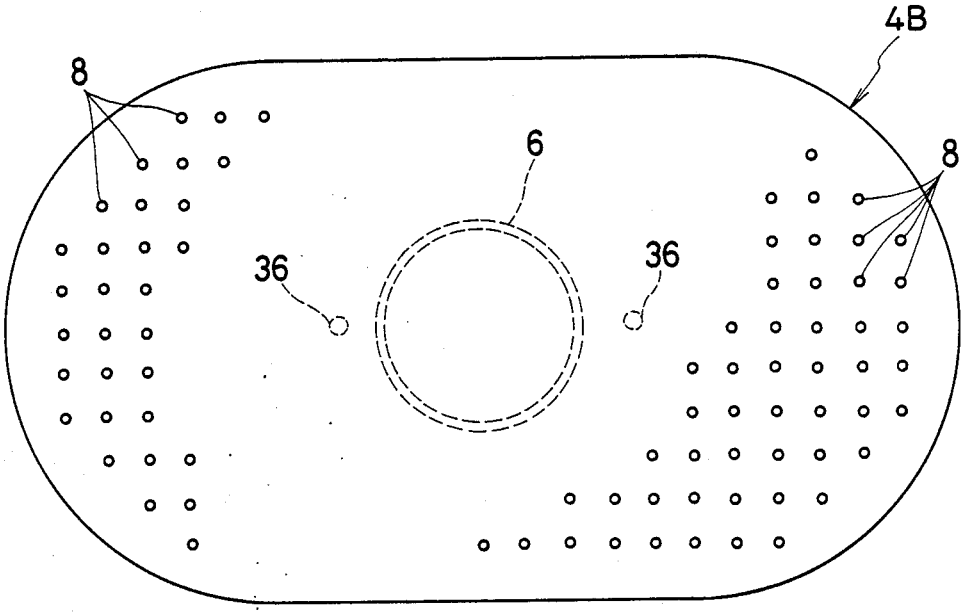
FIG. 9 is a plan view of the ironing table for a garment body.
Figure 10:
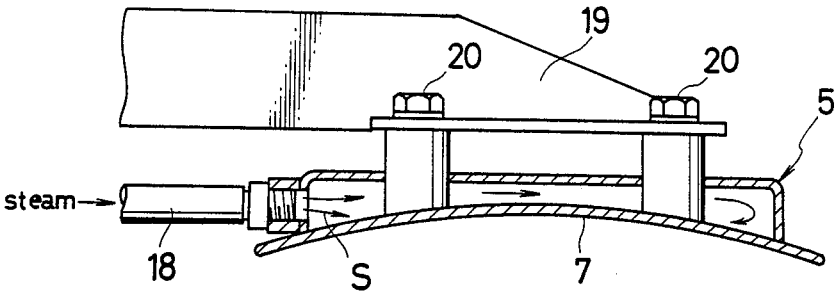
FIG. 10 is a partially cut away sectional view of a pressing plate.

Each of the ironing tables 4A and 4B contains a partition 35 which divides the interior space thereof into upper and lower portions, as shown in FIGS. 6 and 8. Particularly as best seen in FIGS. 6 and 8, the lower space is fluidly connected to a steam supply nozzle 36 which is in turn connected by a steam supply line 37 to the steam supply port so that either of the ironing tables 4A and 4B can continuously be heated to a constant degree of temperature by the flow of steam S, as shown in FIGS. 6 and 8.

Figure 11:
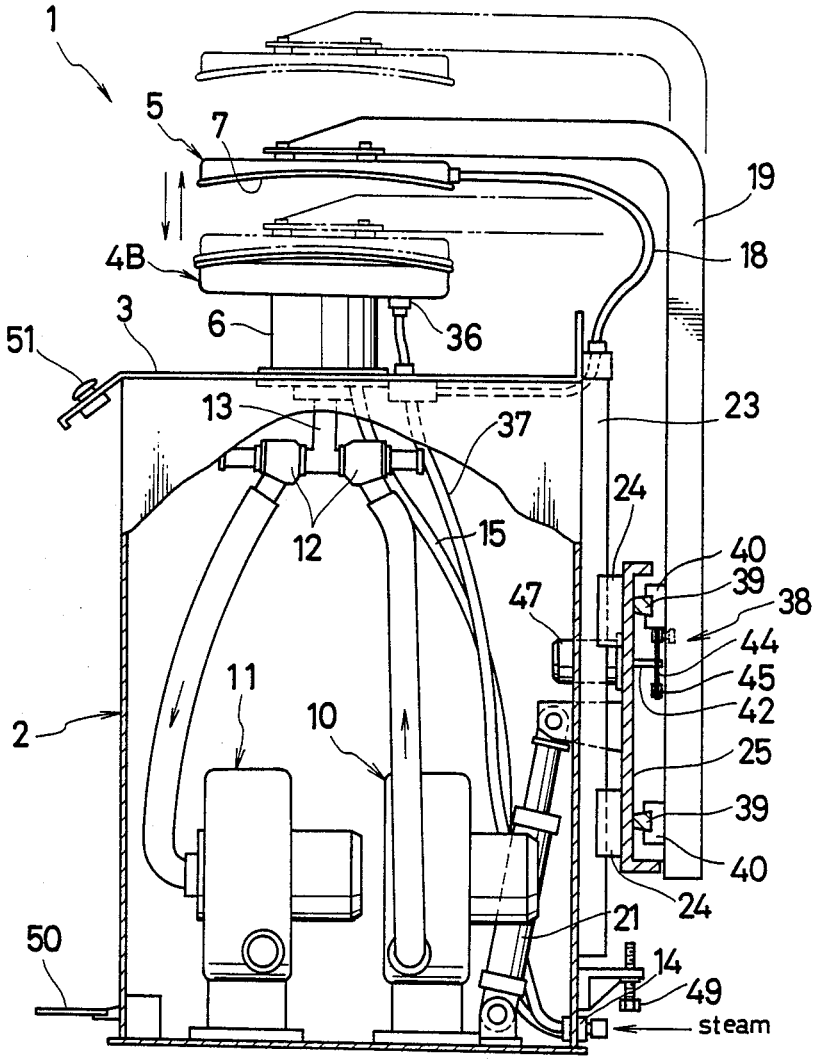
FIG. 11 is a partially cut away sectional view of the apparatus shown in FIG. 5.
Figure 12:
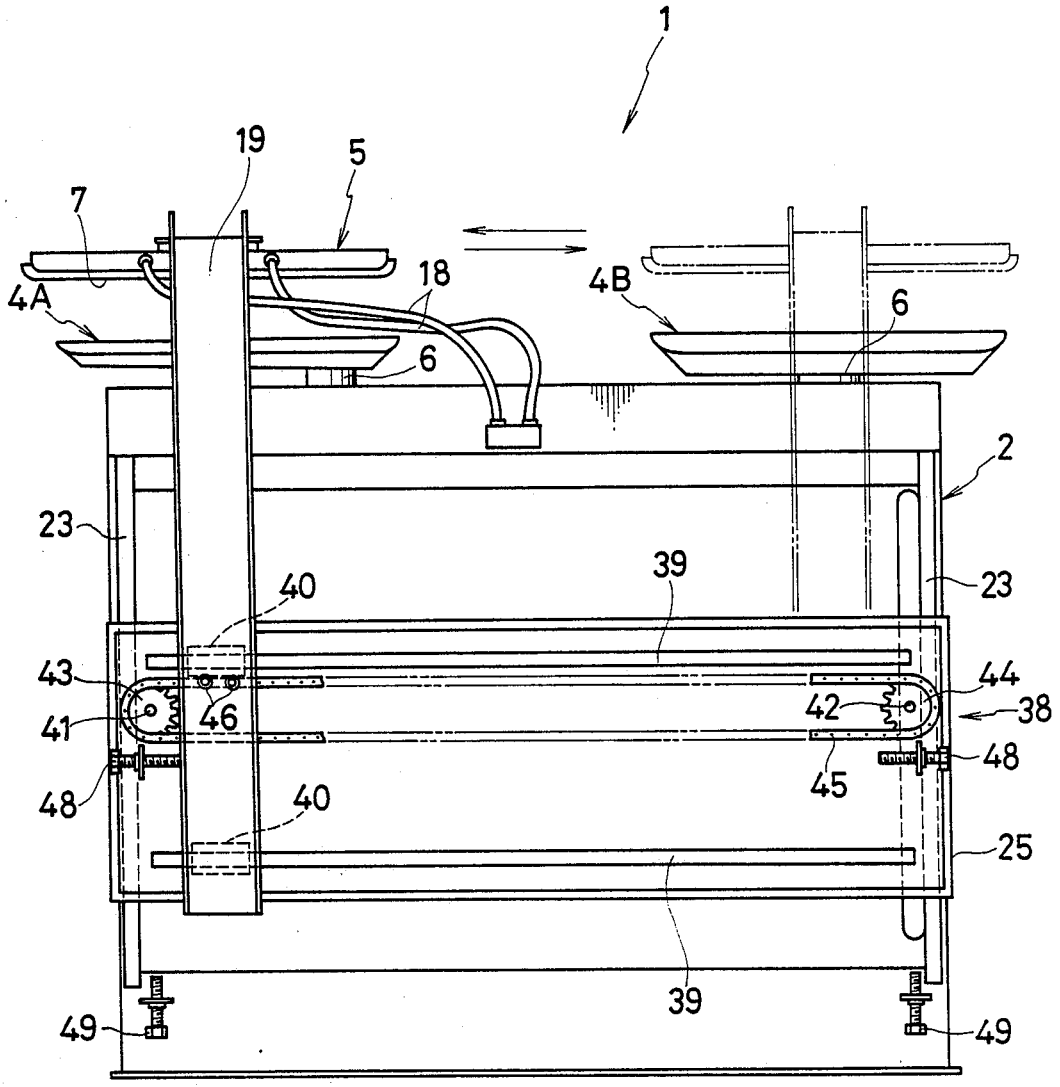
FIG. 12 is an explanatory view of a horizontally moving mechanism.

Specifically according to the second embodiment, mounted on the back of the main body 2 is a lift member 25 actuated by a lifting cylinder 21 for upward and downward movement as shown in FIGS. 11 and 12. The lift member 25 has a lateral moving means 38 mounted to the back thereof for actuating a single pressing plate 5 through an inverted L-shaped support arm 19 to move rightward and leftward.

The lateral moving means 38 is constructed in the following arrangement.

Two of laterally extending guide rails 39, 39 arranged parallel to each other are mounted to the back of the lift member 25. The support arm 19 has two sliding blocks 40 fixedly mounted to the lower end thereof. The sliding blocks 40 are also mounted for sliding movement to the guide rails 39 respectively.

Additionally, the lift member 25 has a follower shaft 41 and a driving shaft 42 mounted respectively in the right and left ends thereof. The shafts 41 and 42 incorporate two sprockets 43 and 44 fitted thereon respectively, between which a chain 45 is fitted at tension. The chain 45 is joined by chain attachments 46 to one of the sliding blocks 40. The driving shaft is driven by a motor 47.

As the chain 39 is driven by the motor 47, the support arm 19 horizontally moves rightward and leftward and thus, the pressing plate 5 advances to a position ralative to either of the ironing tables 4A and 4B.

A pair of stoppers 48 restricting the movement of the support arm 19 are mounted to both the ends of the lift member 25 while another pair of stoppers 49, 49 defining the lower limit of movement of the lift member 25 are mounted in the lower back of the main body 2.

Figure 5:
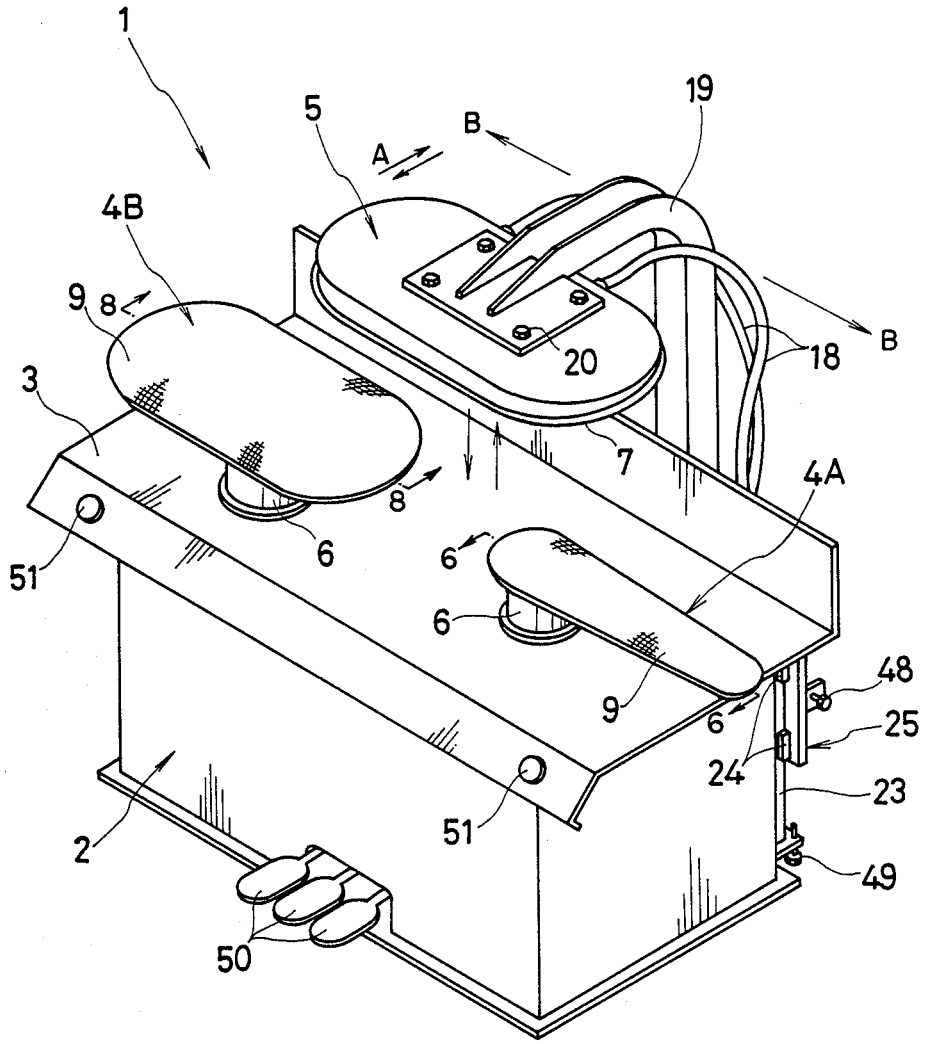
FIG. 5 is an external perspective view of an ironing apparatus accordng to another embodiment.

As shown in FIG. 5, a group of foot switches 50 are mounted in the lower end on the working side of the main body 2 to control the air supply of the air supply blower 10, the air suction of the air suction blower 11, and the discharge of steam from the steam supply line 15. Additionally, two pushbutton switches 51 which control the movement of the pressing plate 5 with respect to the upward, downward, rightward, and leftward directions are respectively mounted in both ends of the front sloping portion of the working surface 3.

The operation in the ironing apparatus formed in such an arrangement will now be described. A sleeve of a garment is placed on the ironing table 4A, one of the tables shown in FIG. 5, while a body of the same is placed on the other ironing table 4B in preparation for an ironing operation. One of the foot switches 50 is then pressed and then, the garment is tightly held by suction to the ironing tables 4A and 4B while being kept stretched without wrinkles.

The pressing plate 5 is vertically moved downward to the ironing table 4A (with the sleeve) when one of the pushbutton switches 51 is turned on and presses against the sleeve of the garment on the ironing table 4A.

After pressing, the other foot switch 50 is pressed to stop the air suction blower 11. The steam S from a steam supply device (not shown) is uniformly discharged from a multiplicity of tiny holes 8 formed in the upper surface of the ironing table 4A so that the garment can be steamed under pressure for a specified time.

The last one of the foot switches 51 is then pressed to stop the discharge of steam S. The pressing plate 5 is moved vertically upward with its pressing surface facing the ironing table 4A when the other pushbutton switch 51 is turned on. Simultaneously, the air supply blower 10 is actuated to uniformly supply a flow of air through the tiny hole 8 in the upper surface of the ironing table 4A. The air cools the sleeve of the garment and the garment thus remains smooth without wrinkles.

On the other hand, the pressing plate 5 at its upper position is horizontally moved with its pressing surface 7 facing downward to above the ironing table 4B located next to the table 4A. Then, the pressing plate 5 is vertically moved downward to the ironing table 4B for ironing the body of the garment when the pushbutton switch 51 is turned on in the same manner described above.

During a period when the pressing plate 5 presses on the ironing table 4A for ironing the sleeve of the garment, it is possible to place the body of the garment over the ironing table 4B in preparation for ironing. Thus, the single pressing plate 5 can effectively be utilized, which improves workability.

Additionally, the pressing plate 5 moves with its pressing surface facing downward so that hot air therefrom is prevented from blowing directly against the face or hands of an operator who can thus carry out ironing under a safe working condition.

Furthermore, according to this invention, a plurality of ironing tables, not limited to the two ironing tables 4A and 4B of the embodiment, are successively attachable of distinct shape corresponding to each part of the garment to be ironed. It is thus possible to carry out ironing of e.g. a sleeve and a body of a garment at a time on one single ironing apparatus.

What is claimed is:

1. An ironing apparatus comprising a main body having a working surface on a top thereof;

at least one ironing table horizontally disposed on said working surface of said main body, said ironing table having forward; backward, right and left sides;

a pressing plate disposed generally above said at least one ironing table; and means for moving said pressing plate substantially vertically to and away from said ironing table and for moving said pressing plate horizontally above said at least one ironing table, said means for moving comprising a vertical holder disposed at a rear side of said main body;

a horizontal holder connected to one end of said vertical holder;

means for connecting said pressing plate to said horizontal holder so that said pressing plate is disposed generally above said at least one ironing table; and a lift mechanism connected to generally another end of said vertical holder for moving said vertical holder vertically or horizontally so that said pressing plate is moved substantially vertically to and away from at least a part of said at least one ironing table and so that said pressing plate is moved horizontally to a position generally above said at least one ironing table and to a position away from at least part of said at least one ironing table.

2. The apparatus of claim 1, wherein said lift mechanism comprises means for moving said vertical holder so that said pressing plate is moved leftward and rightward of said at least one ironing table.

3. The apparatus of claim 6, wherein said lift mechanism comprises means for moving said vertical holder so that said pressing plate is moved forward or rearward of said at least one ironing table.

4. The apparatus of claim 6, wherein a plurality of ironing tables are provided.

* * * * *